US005266120A

United States Patent [19]

Dambrine

[11] Patent Number: 5,266,120

[45] Date of Patent: Nov. 30, 1993

[54] PROCESS AND APPARATUS FOR THE PRE-TREATMENT OF CUT SUGAR BEETS

[76] Inventor: Francis Dambrine, Résidence Dauphine, rue Croix Rouge, 78430 Louveciennes, France

[21] Appl. No.: 897,611

[22] Filed: Jun. 10, 1992

Related U.S. Application Data

[63] Continuation of Ser. No. 638,209, Jan. 7, 1991, abandoned.

[30] Foreign Application Priority Data

Jan. 24, 1990 [FR] France ..... 90 00783

[51] Int. Cl.[5] ..... C13D 1/14

[52] U.S. Cl. ..... 127/44; 127/45

[58] Field of Search ..... 127/44, 45

[56] References Cited

U.S. PATENT DOCUMENTS 2,930,131 12/1945 Silver ..... 127/45

3,275,472 9/1966 Tantawi et al. ..... 127/45

4,555,270 11/1985 Ponant ..... 127/44

OTHER PUBLICATIONS

*Webster's New Collegiate Dictionary*, p. 315.

*Primary Examiner*—Theodore Morris

*Assistant Examiner*—Patricia L. Hailey

*Attorney, Agent, or Firm*—Collard & Roe

[57] ABSTRACT

A preliminary treatment of sliced sugar beets before they are subjected to diffusion comprises a first stage wherein the sliced sugar beets are contacted with a first solution of calcium monosaccharate while the sliced sugar beets and the calcium monosaccharate solution flow countercurrently to each other, and a second stage wherein the sliced sugar beets are contacted with a second solution of calcium monosaccharate while the sliced sugar beets and the calcium monosaccharate solution flow concurrently with each other.

10 Claims, 2 Drawing Sheets

PROCESS AND APPARATUS FOR THE PRE-TREATMENT OF CUT SUGAR BEETS

This is a continuation of copending application Ser. No. 07/638,209 filed on Jan. 7, 1991, now abandoned.

BACKGROUND OF THE INVENTION

1. Field of the Invention

The present invention relates to improvements in the extraction of sugar from sliced sugar beets by diffusion, in which operation the sliced sugar beets are subjected to extraction by a countercurrent flow of hot water to produce, on the one hand, a sugar juice which is purified before being concentrated by evaporation, whereupon it is subjected to crystallization, and a pulp, on the other hand, which is pressed to extract therefrom an aqueous liquid which is recycled for the diffusion extraction and then dried.

2. Description of the Prior Art

It is known from U.S. Pat. No. 4,555,270, dated Nov. 26, 1985, to reduce the content of pectic substances in the juice and to improve the pressing of the residual pulp by a pre-treatment in which the sliced sugar beets are contacted with a calcium monosaccharate solution before the diffusion, the solution being obtained by adding quick lime or milk-of-lime to the diffusion juice. For this purpose, a layer of the sliced sugar beets is placed on a permeable conveyor belt and, during their conveyance, the sugar beets are sprinkled with a cold solution of the monosaccharate (saccharated juice) which is passed several times through the layer of sliced sugar beets to obtain a countercurrent circulation so that the concentration of the monosaccharate in the solution decreases from the first passage through the layer of sliced sugar beets (at the side of the diffusion) to the last passage (at the side where the sugar beets are charged onto the belt). Thus, the reaction of fixing the calcium on the sliced sugar beets is progressive. Before this pre-treatment, the sliced sugar beets are washed or leached with a suitable liquid to remove therefrom dry materials contained in the open cells of the sugar beets. For this purpose, purified sugar juice or, preferably, spent saccharated juice may be used, the latter having the advantage of reducing the volume of recycled purified juice.

The countercurrent circulation of the saccharated juice and the sliced sugar beets makes it necessary to sprinkle the sliced sugar beets with a solution containing a considerable amount of the monosaccharate just before they enter the diffusion stage. Despite special precautions taken (permitting the monosaccharate solution to drip out of the mass of sliced beets or pressing it out), a fraction of the monosaccharate solution is entrained with the sliced sugar beets into the diffusion apparatus. However, the calcium monosaccharate is unstable in the presence of heat and, as soon as it enters the diffusion zone, it is decomposed into saccharose and lime. The action of lime on sliced sugar beets produces a number of undesirable reactions, such as deacetylation, formation of salts of lime, floculation, etc. This disadvantage is further aggravated when the saccharated juice contains hydrated lime ($CaOH_2$).

SUMMARY OF THE INVENTION

It is the primary object of this invention to provide such a circulation of the sliced sugar beets and the calcium monosaccharate solution during the pre-treatment that the content of the monosaccharate in the juice retained in the sugar beets is strongly reduced, preferably to substantially zero, in order to avoid the above-noted disadvantages while maintaining optimal reaction conditions.

The above and other objects are accomplished in a process for the preliminary treatment of sliced sugar beets before they are subjected to diffusion, according to one aspect of the invention, by contacting the sliced sugar beets in a first stage with a first solution of calcium monosaccharate while the sliced sugar beets and the calcium monosaccharate solution flow countercurrently to each other, and in a second stage with a second solution of calcium monosaccharate while the sliced sugar beets and the calcium monosaccharate solution flow concurrently with each other.

Preferably, the treatment conditions in the first and second stages are so selected that the solutions contain substantially no calcium monosaccharate after the solutions have reacted with the sliced sugar beets during the first and second stages of the preliminary treatment.

The sliced sugar beets may be washed with the first solution after the solution has reacted with the sliced sugar beets during the first stage before the sliced sugar beets are contacted with the first solution during the first stage.

It will be advantageous to recuperate the second solution after completion of the second stage for use in the preparation of the first solution. A monosaccharated sugar beet juice may be produced in a reactor, and a portion of the recuperated second solution is then mixed with one fraction of the monosaccharated sugar beet juice to prepare the first solution, and the second solution is prepared by mixing the other fraction of the monosaccharated sugar beet juice with a recycled portion of the second solution.

According to another aspect of the present invention, an apparatus for the preliminary treatment of sliced sugar beets before they are subjected to diffusion comprises a first treatment section wherein the sliced sugar beets are contacted with a first solution of calcium monosaccharate while the sliced sugar beets and the calcium monosaccharate solution flow counter-currently to each other, and a second treatment section wherein the sliced sugar beets are contacted with a second solution of calcium monosaccharate while the sliced sugar beets and the calcium monosaccharate solution flow concurrently with each other. Such an apparatus may comprise a permeable conveyor belt moving in a conveying direction and carrying the sliced sugar beets in a layer of substantially uniform thickness, the first treatment section extending along the conveyor belt upstream in the conveying direction and comprising a first set of distributors for the first calcium monosaccharate solution, collectors associated with the distributors and pumps circulating the first solution countercurrently to the conveying direction, and the second treatment section extending along the conveyor belt downstream from the upstream section in the conveying direction and comprising a second set of distributors for the second calcium monosaccharate solution, collectors associated with the distributors and pumps circulating the second solution concurrently to the conveying direction.

BRIEF DESCRIPTION OF THE DRAWING

The above and other objects, advantages and features of this invention will become more apparent from the following detailed description of certain now preferred embodiments thereof, taken in conjunction with the accompanying schematic drawing wherein.

DETAILED DESCRIPTION OF PREFERRED EMBODIMENTS

Figure 1:
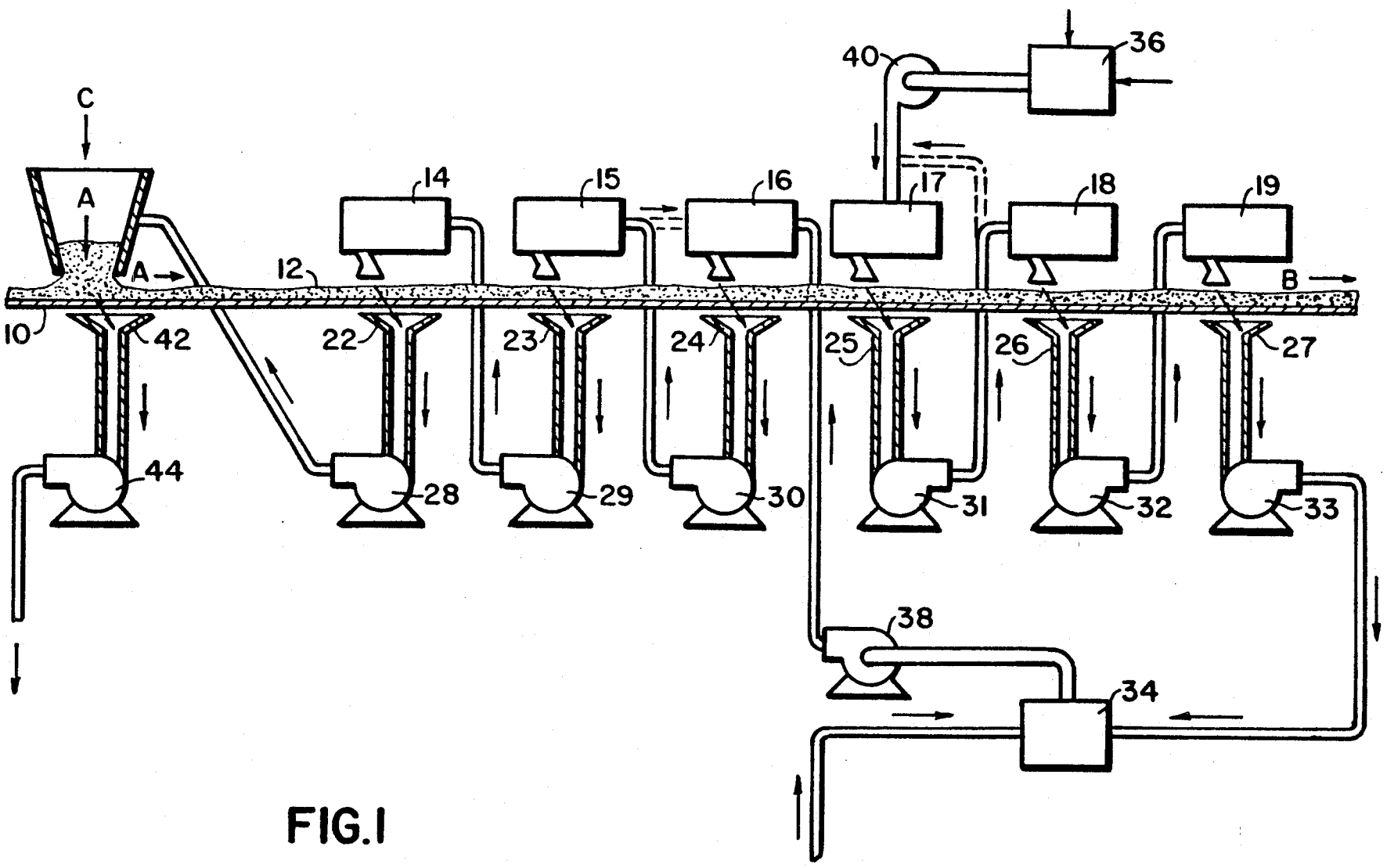
FIG. 1 is a diagram of one embodiment of an installation for the practice of the invention.

Referring now to the drawing, wherein like reference numerals designate like parts functioning in a like manner, there is shown an apparatus for the preliminary treatment of sliced sugar beets before they are subjected to diffusion, which comprises permeable conveyor belt 10 moving in a conveying direction and carrying the sliced sugar beets in layer 12 of substantially uniform thickness. Conveyor belt 10 may be an endless band placed upstream of a diffusion apparatus (not shown) to serve merely for the pre-treatment or it may be a long endless belt whose upstream portion serves for the pre-treatment and which has a downstream portion where the diffusion is effected. For the pre-treatment, the sliced sugar beets are charged on conveyor belt 10 at A at the beginning of a first treatment section extending along the conveyor belt upstream in the conveying direction to form a relatively thick layer 12 of substantially uniform thickness, and the sliced sugar beets are subjected to a calcification treatment as they are conveyed downstream towards point B at the end of the pre-treatment from the first treatment section to a second treatment section.

The first treatment section comprises a first set of distributors 14, 15, 16 for a first calcium monosaccharate solution, collectors 22, 23, 24 associated with the distributors and pumps 28, 29, 30 circulating the first solution countercurrently to the conveying direction (indicated by horizontal arrows). The second treatment section extending along conveyor belt 10 downstream from the upstream section in the conveying direction comprises a second set of distributors 17, 18, 19 for a second calcium monosaccharate solution, collectors 25, 26, 27 associated with the distributors and pumps 31, 32, 33 circulating the second solution concurrently to the conveying direction. As the monosaccharate solutions pass through layer 12, the sliced sugar beets are contacted with the first solution of calcium monosaccharate while the sliced sugar beets and the calcium monosaccharate solution flow counter-currently to each other, and then with the second solution of calcium monosaccharate while the sliced sugar beets and the calcium monosaccharate solution flow concurrently with each other.

Liquid distributors 14 to 19 may be arrays of sprinklers or nozzles or overflowing troughs extending across the entire width of conveyor belt 10 and placed thereabove at predetermined distances in the conveying direction. Collectors 22 to 27 are placed below the belt and arranged to receive the liquid from the associated distributors after pumps 28 to 33 have circulated the liquid from the distributors through the sliced sugar beets, first countercurrently to, and then concurrently with, the flow of the sliced sugar beets in the conveying direction.

In the embodiment illustrated in FIG. 1, the first solution of calcium monosaccharate is produced in reactor 34 and delivered to distributor 16 of the first set of distributors by pump 38 while the second solution of calcium monosaccharate is produced in reactor 36 and delivered to distributor 17 of the second set of distributors by pump 40. These solutions are produced in the reactors from sugar juice and powdered quick lime.

During operation, the first solution of calcium monosaccharate received from reactor 34 is sprinkled on layer 12 of sliced sugar beets by distributor 16 and is circulated through the sliced sugar beets into collector 24 whence pump 30 circulates the solution countercurrently to the flow of the sliced beets to distributor 15, and on to collector 23, distributor 14 and collector 22, all in the same countercurrent direction and with the solution passing several times through layer 12. In contact with the sliced sugar beets, the calcium ions dissolved in the monosaccharate solution affix themselves to the sliced sugar beets which are thus progressively enriched with calcium while the solution progessively loses monosaccharate during this first pre-treatment stage.

The flow rate of the solution from reactor 34 and its monosaccharate content as well as the number of passages through the layer of sliced sugar beets is so selected that the content of monosaccharate in the solution in final collector 22 is substantially zero. This juice is fed by pump 28 from collector 22 to the batch of sliced sugar beets at C to wash the sliced sugar beets with the first solution after the solution has reacted with the sliced sugar beets during the first stage before the sliced sugar beets are contacted with the first solution during the first stage for calcification thereof. A fraction of this exhausted juice is retained by the sliced sugar beets fed to conveyor belt 10 at A while another fraction thereof passes through layer 12 and is received in collector 42 whence it is delivered by pump 44 to a purification stage.

The saccharated juice delivered to layer 12 of the sliced sugar beets by distributor 17 immediately downstream of distributor 16 in the second pre-treatment stage is received by collector 25, whence pump 31 circulates the second solution concurrently with the flow of the sliced beets to distributor 18, and on to collector 26, distributor 19 and collector 27, all in the same concurrent direction and with the solution passing several times through layer 12. In contact with the sliced sugar beets, the calcium ions dissolved in the second monosaccharate solution affix themselves to the sliced sugar beets which are thus progressvely enriched with calcium while the solution progessively loses monosaccharate during this second pretreatment stage. Again, the flow rate of the second solution coming from reactor 36 and its monosaccharate content as well as the number of passages through the layer of sliced sugar beets is so selected that the content of monosaccharate in the solution in final collector 27 is substantially zero. This juice, or a fraction thereof, is fed by pump 33 from collector 27 to reactor 34 where it may be reacted with quick lime to prepare the first solution fed to distributor 16. The reactor may also be a simple mixer where a fraction of the juice coming from collector 27 is mixed with the saccharated juice produced in reactor 36, for example.

Since the juice utilized for the preparation of the saccharated juice in reactor 36, and possibly also in reactor 34, is a pure sugar juice, it is desirable to use as little of this juice as possible. But, on the other hand, the calcification reaction during the pre-treatment benefits from a large amount of saccharated juice while too high an alkalinity of the juice may cause de-acetylation. Therefore, it may be advantageous to recycle a fraction of the juice after its passage through the sliced sugar beets during the first pre-treatment stage and possibly also after the second pre-treatment stage. Therefore, a portion of the second solution delivered by pump 31 may be returned to distributor 17 and a portion of the first solution delivered by pump 30 may be returned to distributor 16, as shown in broken lines in FIG. 1.

Figure 2:
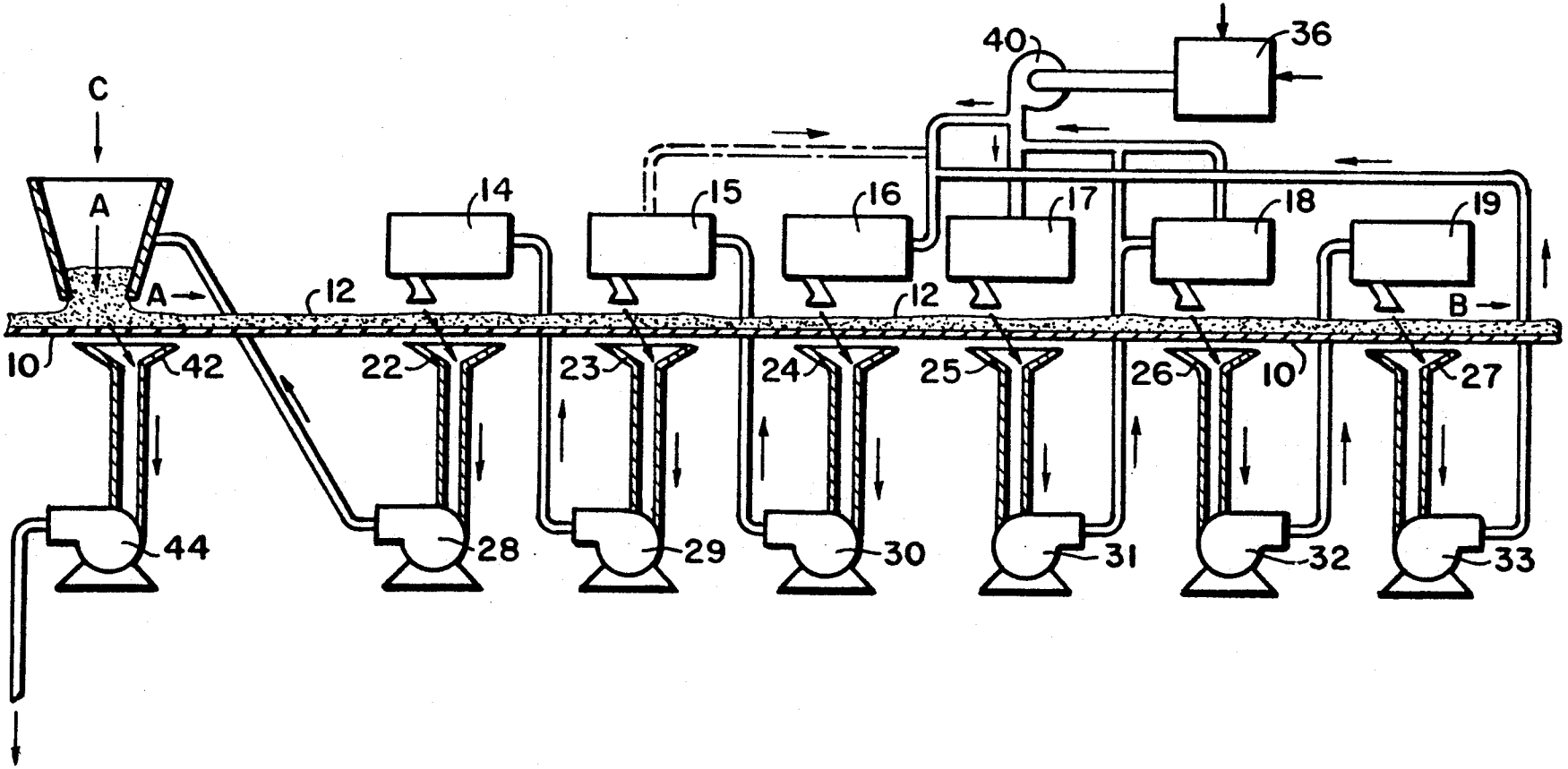
FIG. 2 is a like diagram showing another embodiment.

In the embodiment shown in FIG. 2, the second solution is recuperated from collector 27 of the second stage after it has reacted with the sliced sugar beets and is delivered to distributor 16 by pump 33 and this exhausted second solution is mixed with a fraction of the monosaccharated sugar beet juice produced in reactor 36 to constitute the first solution. Another fraction of the monosaccharated sugar beet juice produced in reactor 36 is mixed with a portion of the second solution delivered by pump 31 which returns this portion to distributor 17 while it delivers another portion to distributor 18. In distributor 17 or in the pipe upstream of the distributor, the second solution is prepared by mixing the other fraction of the monosaccharated sugar beet juice produced in reactor 36 with the portion of the second solution delivered by pump 31.

The pre-treatment according to the present invention enables the content of monosaccharate in the juice retained in the sliced sugar beets to be reduced substantially to zero at the point when they are introduced into the diffusion zone, thus eliminating the above-described difficulties encountered during the diffusion process due to the presence of lime. This, in turn, reduces the required amount of calcium monosaccharate by 20% to 30% and produces corresponding savings in the preparation of powdered lime and saccharated sugar juice, which are the reactants required for the preparation of the pre-treatment solution. It has the further advantage that the diffusion plant operates more stably because it is not subject to fluctuations in the composition of the juice retained in the sliced sugar beets being subjected to diffusion. The resultant sugar juice derived from the diffusion is clearer and can be more easily purified.

Apparatus different from that herein described and claimed may be used for carrying out the pre-treatment according to this invention. For example, the moving conveyor belt may be replaced by a horizontal trough holding a screw conveyor for conveying the sliced sugar beets through the pre-treatment stages. Also, the solution may be supplied to the two stages from an input intermediate the end points of the pre-treatment zone and the first and second solutions may be discharged at the upstream and downstream end points, respectively.

What is claimed is:

1. A process for the preliminary treatment of sliced sugar beets before they are subjected to extraction of sugar by diffusion, which comprises (a) contacting the sliced sugar beets with a first solution of calcium monosaccharate, said contacting occurring in a first stage while the sliced sugar beets and the calcium monosaccharate solution flow countercurrently to each other;

(b) contacting the sliced sugar beets with a second solution of calcium monosaccharate, said contacting occurring in a second stage while the sliced sugar beets and the calcium monosaccharate solution flow concurrently with each other; and (c) transporting said sliced sugar beets from said concurrent flow second stage to an extraction stage.

2. The process of claim 1, wherein the second solution is used after completion of the second stage for preparing the first solution.

3. The process of claim 2, wherein the second solution is recuperated from the second stage after it has reacted with the sliced sugar beets, a monosaccharated sugar beet juice is produced in a reactor, and the recuperated second solution is mixed with one fraction of the monosaccharated sugar beet juice to prepare the first solution, and the second solution is prepared by mixing the other fraction of the monosaccharated sugar beet juice with a recycled portion of the second solution.

4. An apparatus for the preliminary treatment of sliced sugar beets before they are subjected to extraction of sugars by diffusion, which comprises (a) a first treatment stage having means for transporting said beets from the upstream end to the downstream end, and having means for simultaneously transporting a first solution of calcium monosaccharate from the downstream end to the upstream end, and having first treatment means wherein the sliced sugar beets are contacted with said first solution of calcium monosaccharate while the sliced sugar beets and the calcium monosaccharate solution flow counter-currently to each other;

(b) a second treatment stage having means for transporting said beets from the upstream end to the downstream end, and having means for simultaneously transporting a second solution of calcium monosaccharate from the upstream end to the downstream end, and having second treatment means wherein the sliced sugar beets are contacted with said second solution of calcium monosaccharate while the sliced sugar beets and the calcium monosaccharate solution flow concurrently with each other; and (c) means for transporting said sliced sugar beets from said concurrent flow second treatment stage to an extraction stage.

5. The apparatus of claim 4, comprising a permeable conveyor belt moving in a conveying direction and carrying the sliced sugar beets in a layer of substantially uniform thickness, the first treatment stage extending along the conveyor belt upstream in the conveying direction and comprising a first set of distributors for the first calcium monosaccharate solution, collectors associated with the distributors and pumps circulating the first solution countercurrently to the conveying direction, and the second treatment stage extending along the conveyor belt downstream from the upstream section in the conveying direction and comprising a second set of distributors for the second calcium monosaccharate solution, collectors associated with the distributors and pumps circulating the second solution concurrently to the conveying direction.

6. A process for the preliminary treatment of sliced sugar beets before they are subjected to extraction of sugar by diffusion, which comprises (a) contacting the sliced sugar beets with a first solution of calcium monosaccharate, said contacting occurring in a first stage while the sliced sugar beets and the calcium monosaccharate solution flow countercurrently to each other, the treatment conditions being so selected that the first solution contains substantially no calcium monosaccharate after the solution has reacted with the sliced sugar beets;

(b) contacting the sliced sugar beets with a second solution of calcium monosaccharate, said contacting occuring in a second stage while the sliced sugar beets and the calcium monosaccharate solution flow concurrently with each other; and (c) transporting said sliced sugar beets from said concurrent flow second stage to an extraction stage.

7. The process of claim 6, comprising the further step of washing the sliced sugar beets, before they are contacted with the first solution during the first stage, with the first solution containing substantially no calcium monosaccharate.

8. A process for the preliminary treatment of sliced sugar beets before they are subjected to extraction of sugar by diffusion, which comprises (a) contacting the sliced sugar beets with a first solution of calcium monosaccharate, said contacting occurring in a first stage while the sliced sugar beets and the calcium monosaccharate solution flow countercurrently to each other;

(b) contacting the sliced sugar beets with a second solution of calcium monosaccharate, said contacting occurring in a second stage while the sliced sugar beets and the calcium monosaccharate solution flow concurrently with each other, the treatment conditions being so selected that the second solution contains substantially no calcium monosaccharate after the solution has reacted with the sliced sugar beets during the second stage of the preliminary treatment; and (c) transporting said sliced sugar beets from said concurrent flow second stage to an extraction stage.

9. An apparatus for the preliminary treatment of sliced sugar beets before they are subjected to extraction of sugar by diffusion, which comprises (a) a first treatment stage having means for transporting said beets from the upstream end to the downstream end, and having means for simultaneously transporting a first solution of calcium monosaccharate from the downstream end to the upstream end, and having first treatment means wherein the sliced sugar beets are contacted with said first solution of calcium monosaccharate while the sliced sugar beets and the calcium monosaccharate solution flow counter-currently to each other;

the first treatment means being so selected that the first solution contains substantially no calcium monosaccharate after the solution has reacted with the sliced sugar beets during the first stage of the preliminary treatment, and (b) a second treatment stage having means for transporting said beets from the upstream end to the downstream end, and having means for simultaneously transporting a second solution of calcium monosaccharate from the upstream end to the downstream end, and having second treatment means wherein the sliced sugar beets are contacted with said second solution of calcium monosaccharate solution flow concurrently with each other, the second treatment means being so selected that the second solution contains substantially no calcium monosaccharate after the solution has reacted with the sliced sugar beets during the second stage of the preliminary treatment; and (c) means for transporting said sliced sugar beets from said concurrent flow second treatment stage to an extraction stage.

10. A process for the preliminary treatment of sliced sugar beets before they are subjected to extraction of sugar by diffusion, which comprises (a) contacting the sliced sugar beets with a first solution of calcium monosaccharate, said contacting occurring in a first stage while the sliced sugar beets and the calcium monosaccharate solution flow countercurrently to each other, the treatment conditions being so selected that the first solution contains substantially no calcium monosaccharate after the solution has reacted with the sliced sugar beets during the first stage of the preliminary treatment;

(b) contacting the sliced sugar beets with a second solution of calcium monosaccharate, said contacting occurring in a second stage while the sliced sugar beets and the calcium monosaccharate solution flow concurrently with each other, the treatment conditions being so selected that the second solution contains substantially no calcium monosaccharate after the solution has reacted with the sliced sugar beets during the second stage of the preliminary treatment; and (c) transporting said sliced sugar beets from said concurrent flow second stage to an extraction stage.

* * * * *